US005245351A

United States Patent [19]

Chou

[11] Patent Number: 5,245,351

[45] Date of Patent: Sep. 14, 1993

[54] ORIENTATION ADJUSTING DEVICE FOR A SATELLITE TRANSMITTING SIGNAL ANTENNA

[76] Inventor: Hsiao-Feng Chou, 11F-2, No. 31-1, Sec. 2, Hsinsheng N. Rd., Taipei, Taiwan

[21] Appl. No.: 636,609

[22] Filed: Jan. 2, 1991

[51] Int. Cl.[5] ..... H01Q 3/00

[52] U.S. Cl. ..... 343/766; 343/763; 343/765

[58] Field of Search ..... 343/766, 757, 758, 763, 343/759, 878, 880, 882

[56] References Cited

U.S. PATENT DOCUMENTS 4,040,058 8/1977 Mori et al. ..... 343/766
4,126,865 11/1978 Longhurst et al. ..... 343/766
4,672,385 6/1987 Prindle ..... 343/766
4,692,771 9/1987 Rothbarth et al. ..... 343/766
4,841,309 6/1989 Burr ..... 343/766

*Primary Examiner*—Rolf Hille
*Assistant Examiner*—Hoanganh Le

[57] ABSTRACT

An orientation adjusting device for a satellite transmitting signal antenna comprising a housing inside of which an electromechanical actuation system comprising a worm gear-worm pair driven by a motor through a reduction gear set is disposed. A rotatable antenna seat which constitutes, in part, the housing is mechanically connected to the worm gear so as to be driven by the motor. The worm, of which one end is pivotally fixed on the housing, is biased toward the worm gear by biasing means so as to maintain a more precise engagement between the worm and the worm gear and to reduce the backlash associated therewith. Microswitches are provided inside the housing to control the rotation range of the antenna.

9 Claims, 5 Drawing Sheets

ORIENTATION ADJUSTING DEVICE FOR A SATELLITE TRANSMITTING SIGNAL ANTENNA

FIELD OF THE INVENTION

The present invention relates to a device which is used to adjust the orientation of a satellite transmitting signal antenna so as to aim it at a desired orientation to receive a signal from a particular satellite in such an orientation.

BACKGROUND OF THE INVENTION

Conventionally, the orientation of an antenna is adjusted by a rod-like actuator which is illustrated in FIG. 8 of the attached drawings. A motor M rotates a screw S via a reduction gear set G so as to move rod R back and forth. The free end of the rod R is pivotally fixed on the antenna about an axis when the rod extends and/or retracts. A serious disadvantage of the design is that it is difficult to rotate the antenna when the rotated angle is greater than 100 degrees.

To overcome the above-mentioned drawback, a worm and worm gear set is used to replace the rod-like actuator. The design effectively increases the range of rotation. However, as everybody knows, backlash is a phenomenon associated with gearing systems. The problem of backlash increases with the increasing wear and tear of the gear set. A small increment in backlash results in a significant deviation in adjusting the orientation due to the great dimension of an antenna.

In adjusting an antenna, it is necessary to calculate the angle to be rotated with respect to a reference orientation, for example south. It is not possible for the prior art antenna orientation adjusting device to obtain the reference orientation readily. This is also a disadvantage of the prior art.

SUMMARY OF THE INVENTION

It is therefore the object of the invention to provide an orientation adjusting device for a satellite transmitting signal antenna which provides a more precise control in adjusting the orientation of the antenna and a greater range orientation adjustment.

It is another object of the invention to provide an orientation adjusting device for a satellite transmitting signal antenna which provides an orientation calibrating means so as to be easy to obtain a reference orientation.

To achieve the above objects, there is provided an orientation adjusting device for a satellite transmitting signal antenna comprising a housing inside of which an electromechanical actuation system comprising a worm gear-worm pair driven by a motor through a reduction gear set is disposed. A rotatable antenna seat which constitutes, in part, the housing is mechanically connected to the worm gear so as to be driven by the motor. The worm, of which one end is pivotally fixed on the housing, in biased toward the worm gear by biasing means so as to maintain a more precise engagement between the worm and the worm gear and to reduce the backlash associated therewith. Microswitches are provided inside the housing to control the rotation range of the antenna.

BRIEF DESCRIPTION OF THE DRAWINGS

The invention will be described by way of a preferred embodiment which should be considered illustrative only and not a restriction of the scope of the invention, reference being made to the attached drawings, in which.

DETAILED DESCRIPTION OF THE PREFERRED EMBODIMENT

Figure 1:
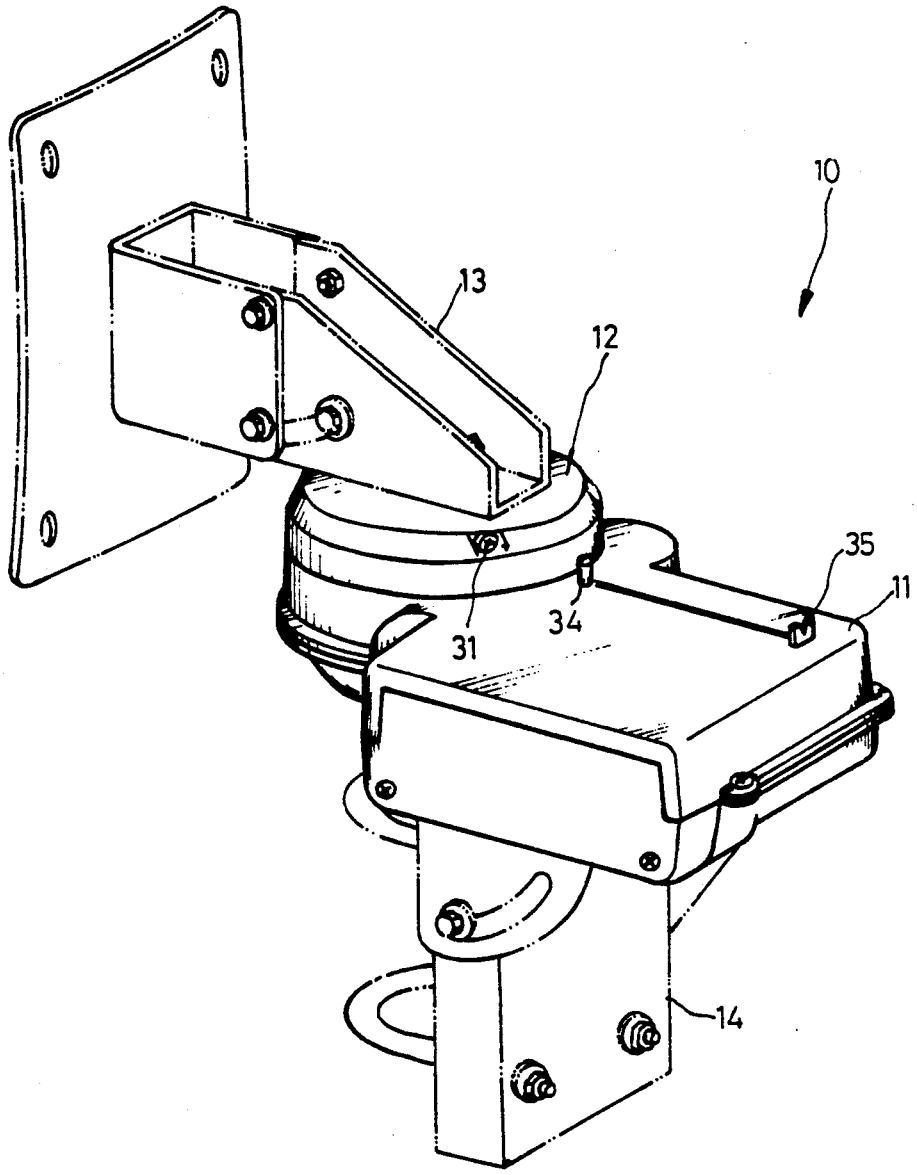
FIG. 1 is a perspective view of an orientation adjusting device for a satellite transmitting signal antenna in accordance with the invention.
Figure 8:
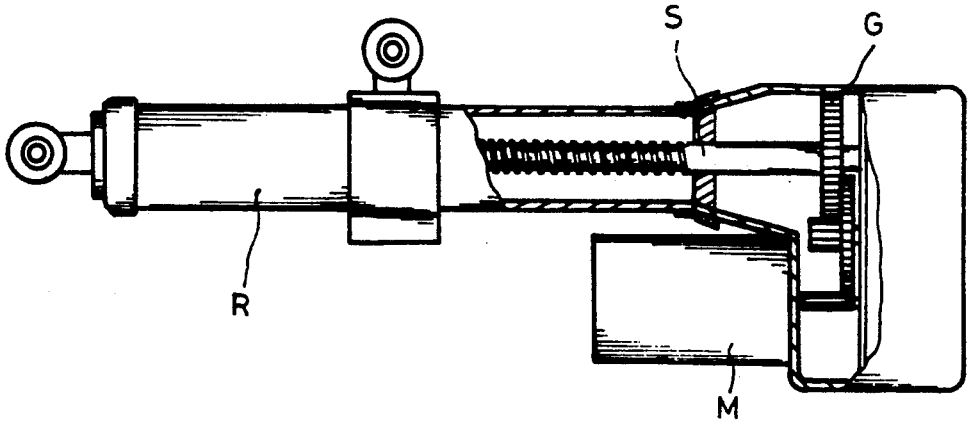
FIG.8 PRIOR ART
FIG. 8 is a perspective view, partly broken, showing a prior art orientation adjusting device for a satellite transmitting signal antenna.

With reference to the drawings and in particular to FIG. 1, an orientation adjusting device for a satellite transmitting signal antenna in accordance with the invention, generally designated by reference numeral 10, comprises a housing 11 which is constituted in part by an antenna seat 12 on which a satellite transmitting signal antenna 13 is fixed. The antenna seat 12 is rotatable with respect to the housing 11. The housing is fixed on a fixture 14.

Figure 2:
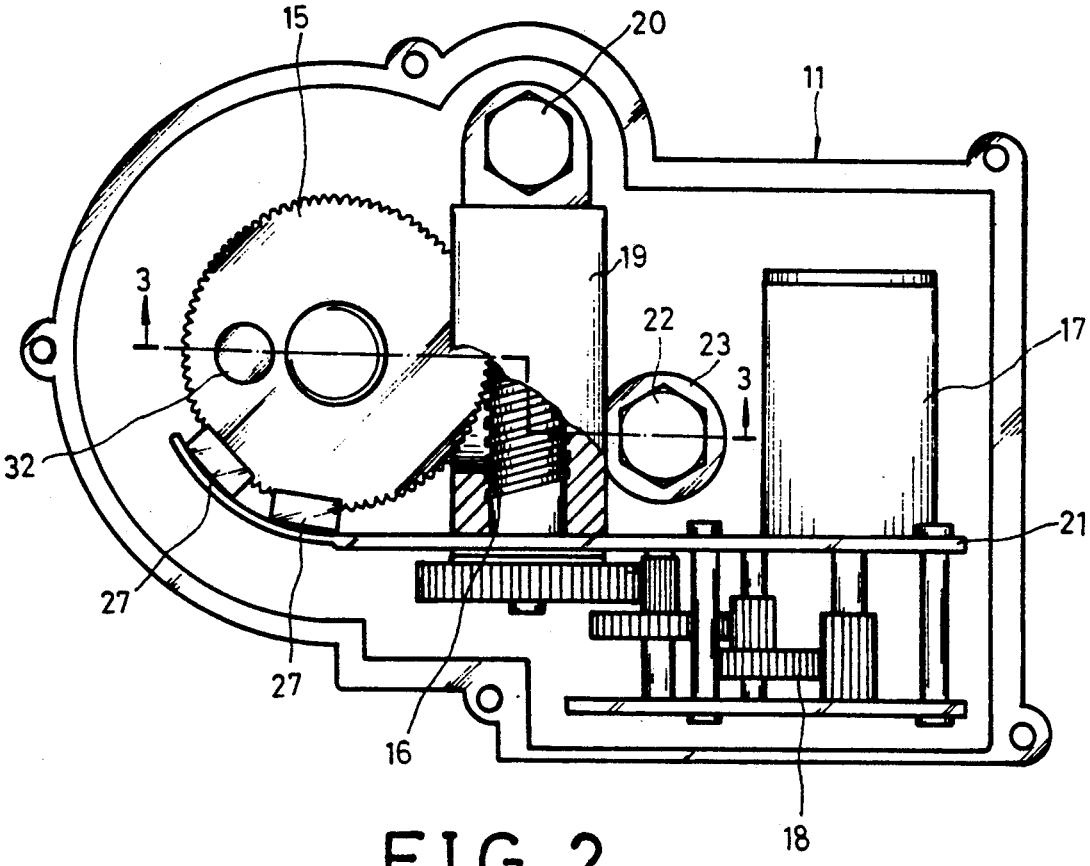
FIG. 2 is a plan view showing the electromechanical actuation system of the orientation adjusting device shown in FIG. 1.

Referring now to FIG. 2, which shows an electromechanical actuation system disposed inside the housing 11, the actuation system comprises a worm gear 15 mating a worm 16 which is driven by a motor 17 via a reduction gear set 18. The worm 16 is enclosed by a jacket 19 which has one end open to allow the worm 16 to engage with the reduction gear set 18 and another end pivotally fixed on the housing 11 by a pivot 20 or the like. The motor 17, as well as the reduction gear set 18, is fixed on a support 21 which is attached on the jacket 19 so that when the jacket 19 rotates about the pivot 20, the motor 17 and the reduction gear set 18 follow.

Figure 3:
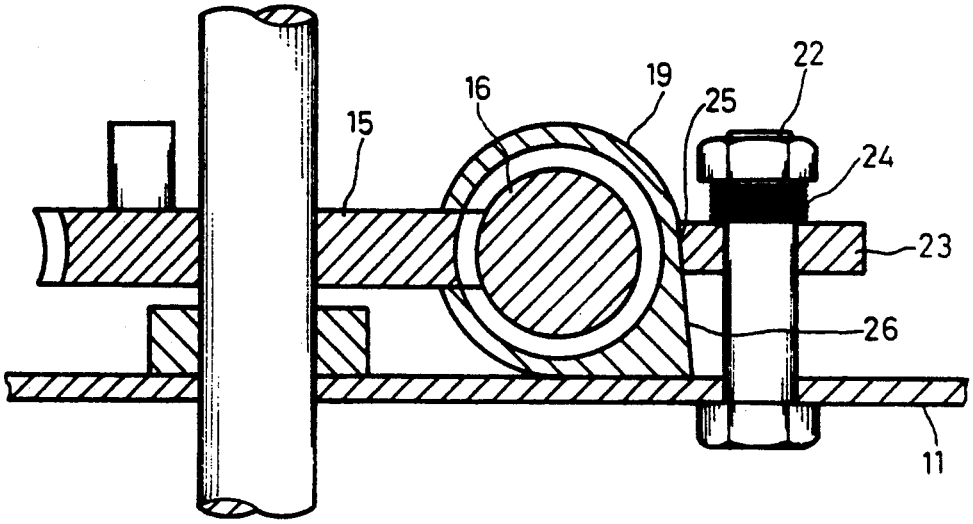
FIG. 3 is a cross-sectional view taken along line 3—3 of FIG. 2.
Figure 4:
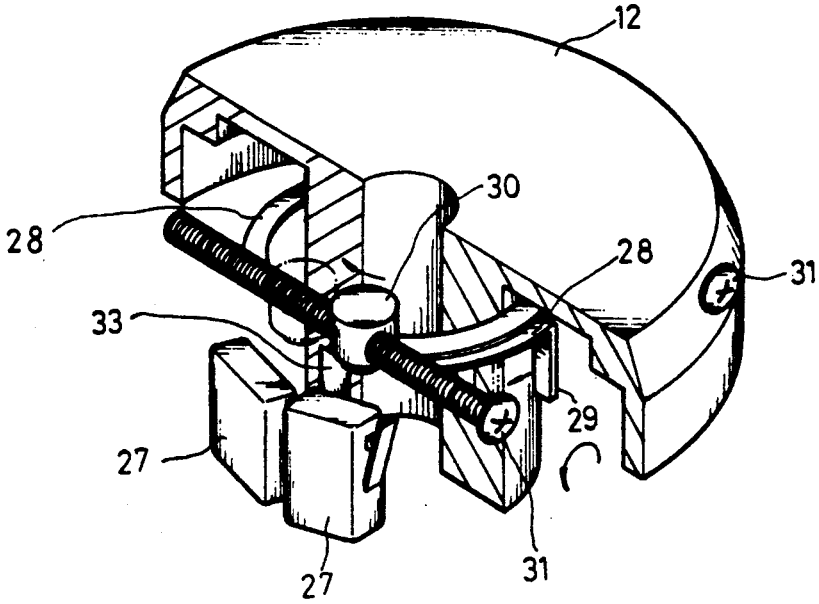
FIG. 4 is a partially broken view showing the microswitches and the triggering means associated therewith.

Further referring to FIG. 3, the jacket 19 which is slidable on the housing 11 is biased by a biasing means which comprises a bolt 22 fixed on the housing 11, a push plate 23 which is slidable along the bolt 22 and is biased by a spring 24. The push plate has an inclined edge 25 which contacts and abuts a slope 26 formed on the jacket 19. The slope 26 and the inclined edge 25 are so formed that the spring force acting upon the push plate 23 is transformed by the inclined edge 25 to push the jacket 19 and, thus, the worm 16 toward the worm gear 15. This arrangement reduces the negative effect of backlash between the mated worm 16 and worm gear 15 and increases the precision of orientation control.

Figure 5:
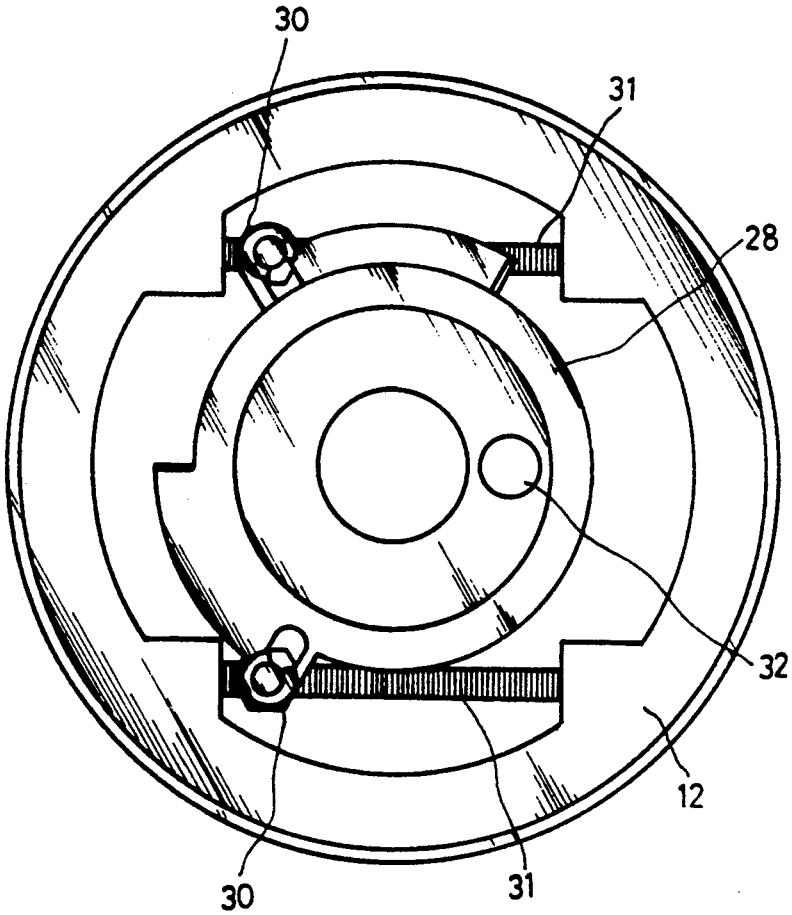
FIG. 5 is a plan view showing the disposal of the triggering means shown in FIG. 4.
Figure 6:
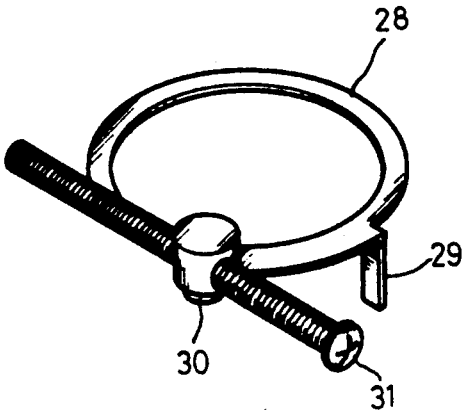
FIGS. 6 and 7 are perspective views of the triggering means showing the adjustment thereof.
Figure 7:
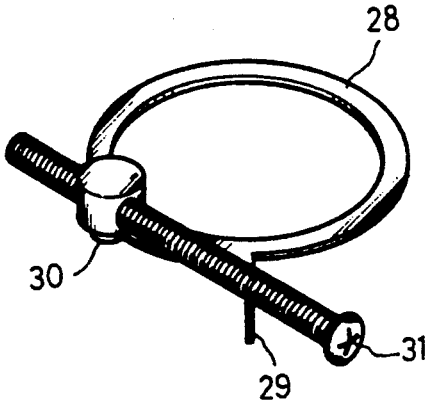

Referring now to FIGS. 4 to 7, microswitches 27 are provided on the support 21 (FIG. 2) and are located at suitable positions relative to triggering means which comprises two rings 28 generally concentrical with the worm gear 15. Each ring 28 has a lug 29 and an inner-threaded block 30 fixed thereon. The block 30 engages with a screw 31 which is rotatably fixed on the antenna seat 12 which is generally rotatable about the same axis as the worm gear 15. By screwing the screw 31, the block 30 moves back and forth along the screw 31. This also moves the lug 29 back and forth. Each microswitch 27 is associated with one of the rings 28 and is so disposed that when the antenna seat 12 is rotated to a desired orientation, the lug 29 of the ring 28 contacts and triggers the microswitch 27. by adjusting the locations of the lugs 29 relative to the microswitches 27 (FIGS. 6 and 7), the rotation limits of the antenna seat 12 can be set up. This is best seen in FIG. 5.

To connect the antenna seat 12 to the worm gear 15, an eccentric projection 32(FIG. 2) is formed on the worm gear 15 and extends into an eccentric hole 33(FIG. 4) formed on the antenna seat 12 so that when the worm gear 15 rotates, the eccentric projection 32 forces the antenna seat 12 to follow.

Referring now back to FIG. 1, to set up a reference direction there is included a sighting device comprising a sight 34 and a sight plug 35. The straight line running between the sight 34 and the sight plug 35 can be aimed at a particular orientation, for example south, and any desired orientation can be precisely obtained with the straight line as a reference.

It should be apparent that although the invention has been described in connection with the preferred embodiment, it is contemplated that those skilled in the art may make changes to certain features of the preferred embodiment without altering the overall basic function and concept of the invention and without departing from the spirit and scope of the invention, as defined in the appended claims.

What is claimed is:

1. An orientation adjusting device for satellite transmitting signal antenna comprising:

a housing which is constituted in part by a rotatable antenna seat having an adjustable range of rotation and on which said satellite transmitting signal antenna is fixed;

an electromechanical actuation system disposed inside said housing, said electromechanical actuation system comprising a worm gear mechanically connected to said antenna seat and co-rotating about a common rotation axis and a worm mating said worm gear and driven by a motor via a reduction gear set; and means for biasing said worm toward said worm gear to maintain a more precise engagement therebetween, said means comprising a bolt fixed on said housing and a push plate which is slidable along said bolt and biased by the force of a spring acting against said push plate, said push plate having an inclined edge which abuts against a slope formed on a jacket which encloses said worm and has one end thereof pivotally fixed on said housing so as to transform said spring force acting upon said plate to push said jacket together with said worm toward said worm gear.

2. An orientation adjusting device as claimed in claim 1 further comprising two microswitches disposed within said housing and means for triggering said microswitches disposed within said housing and adjacent said microswitches whereby contact by said triggering means with said microswitches limits the rotation range of said antenna seat in both the clockwise and counterclockwise direction.

3. An orientation adjusting device as claimed in claim 2 wherein said microswitch triggering means comprises two adjustable rings disposed generally concentrical with said worm gear, said rings each having a lug to contact and trigger each of said microswitches and an inner-threaded block threadably engaging a screw which is rotatably fixed on said antenna seat so that by screwing said screws to move said inner-threaded blocks the positions of said triggering lugs with respect to said microswitches may be adjusted thereby adjusting the rotation range of said antenna seat.

4. An orientation adjusting device as claimed in claim 1 further comprising sighting means affixed to said housing for aiming said satellite transmitting signal antenna at a reference orientation.

5. An orientation adjusting device as claimed in claim 4, wherein said sighting means comprises a sight and a sight plug with a straight line connecting therebetween as a reference line for calibrating the orientation of said satellite transmitting signal antenna.

6. An orientation adjusting device as claimed in claim 1 further comprising two microswitches disposed within said housing and means for triggering said microswitches disposed within said housing and adjacent said microswitches whereby contact by said triggering means with said microswitches limits the rotation range of said antenna seat in both the clockwise and counterclockwise direction.

7. An orientation adjusting device as claimed in claim 6 wherein said microswitch triggering means comprises two adjustable rings disposed generally concentrical with said worm gear, said rings each having a lug to contact and trigger each of said microswitches and an inner-threaded block threadably engaging a screw which is rotatably fixed on said antenna seat so that by screwing said screws to move said inner threaded blocks the positions of said triggering lugs with respect to said microswitches may be adjusted thereby adjusting the rotation range of said antenna seat.

8. An orientation adjusting device as claimed in claim 1 further comprising sighting means affixed to said housing for aiming said satellite transmitting signal at a reference orientation.

9. An orientation adjusting device as claimed in claim 8 wherein said sighting means comprises a sight and a sight plug with a straight line connecting therebetween as a reference line for calibrating the orientation of said satellite transmitting signal antenna.

* * * * *